US010192532B2

(12) United States Patent
Dauré et al.

(10) Patent No.: US 10,192,532 B2
(45) Date of Patent: Jan. 29, 2019

(54) TELESCOPING MUSICAL DRUM

(71) Applicants: Eric Dauré, Westport, CT (US); Michael Aschettino, Clinton, MA (US)

(72) Inventors: Eric Dauré, Westport, CT (US); Michael Aschettino, Clinton, MA (US)

( * ) Notice: Subject to any disclaimer, the term of this patent is extended or adjusted under 35 U.S.C. 154(b) by 0 days.

(21) Appl. No.: 15/253,863

(22) Filed: Aug. 31, 2016

(65) Prior Publication Data

US 2018/0061379 A1 Mar. 1, 2018

(51) Int. Cl.
*G10D 13/02* (2006.01)

(52) U.S. Cl.
CPC ..... *G10D 13/02* (2013.01); *G10D 13/028* (2013.01)

(58) Field of Classification Search
CPC ..... G10D 13/02; G10D 13/028
See application file for complete search history.

(56) References Cited

U.S. PATENT DOCUMENTS 673,633 A * 5/1901 Boulanger ..... G10D 13/028 84/411 R
879,753 A * 2/1908 Eckert ..... B65D 21/086 220/8
881,109 A * 3/1908 Cipar ..... G10D 13/028 84/411 R
1,420,233 A * 6/1922 Baldwin ..... G10D 13/028 84/411 R
1,768,438 A * 6/1930 Clark ..... G10D 13/028 84/412
2,546,452 A * 3/1951 Kmieliauskas ..... G10D 13/028 220/8
3,136,201 A * 6/1964 Lang ..... G10D 13/028 84/270
4,168,646 A * 9/1979 May ..... G10D 13/02 84/411 R
4,300,437 A * 11/1981 Hinger ..... G10D 13/028 84/411 R
4,455,913 A * 6/1984 Willis ..... G10D 13/028 84/412
4,978,021 A * 12/1990 Mini ..... B65D 21/086 220/62.21
5,377,576 A * 1/1995 Good ..... G10D 13/028 84/411 R
6,300,551 B1 * 10/2001 Adinolfi ..... G10D 13/028 84/411 R
6,515,208 B2 * 2/2003 Cleland ..... G10D 13/023 84/411 R
6,666,329 B1 * 12/2003 Charbonneau ..... A45F 3/20 206/218
7,498,498 B2 * 3/2009 Lerner ..... G10D 13/00 84/411 R
7,786,364 B2 * 8/2010 Natali ..... G10D 13/028 84/411 R (Continued)

*Primary Examiner* — Robert W Horn

(57) ABSTRACT

A collapsible musical drum comprised of multiple, sloped walled, nested rings, which may be held alternatively in expanded and collapsed positions by friction fit and/or one or more of several locking mechanisms. These include 1) pegs that slide vertically within, and may, by user-applied torque, be laterally captured by, channels which, in places, protrude from the inner walls of outer rings to stabilize the inner rings when collapsed or expanded 2) a screw-thread mechanism, and 3) one in which nodes on flexible projections are captured by channels running the circumference of constituent rings' outer walls.

20 Claims, 7 Drawing Sheets

(56) References Cited

U.S. PATENT DOCUMENTS

| | | | | |
|---|---|---|---|---|
| 7,888,574 | B1 * | 2/2011 | Acoutin | G10D 13/02 84/411 R |
| 8,829,320 | B2 * | 9/2014 | Tahour | G10D 13/021 84/411 R |
| 2006/0174749 | A1 * | 8/2006 | Lerner | G10D 13/00 84/419 |
| 2012/0000343 | A1 * | 1/2012 | Rothenberg | G10D 13/00 84/421 |
| 2014/0026732 | A1 * | 1/2014 | Spinazzola | G10D 13/028 84/413 |
| 2018/0061379 | A1 * | 3/2018 | Daure | G10D 13/028 |
| 2018/0211641 | A1 * | 7/2018 | Grbinick | G10D 13/028 |

* cited by examiner

TELESCOPING MUSICAL DRUM

CROSS-REFERENCE TO RELATED APPLICATIONS

None

FEDERALLY SPONSORED RESEARCH

None

SEQUENCE LISTING

None

BACKGROUND

This relates to musical drums meant to be played with hands or sticks, and specifically a new variation, generally intended to be comprised of thin, light, flexible, strong, transparent/translucent, modern composite materials (Plastics, esp copolyesters like lexan/tritan), and being comprised of multiple nestable rings, designed to lock into a fully and/or partially extended configuration for play at one or more different pitch levels, and collapse and lock into the outermost ring for easy portability and storage, and which may be playable in seated, reclining, or standing postures, when stationary or mobile, and may be conveniently carryable via integrated dual-purpose strap-attachment-point/finger-holds, and which may be marked by a new transparent/translucent visual aesthetic in both open and closed configurations.

Drums, a form of membranophone generally comprised of a hollow resonant chamber or "shell" covered at one or both ends with a taut vibrant film or "head", traditionally animal skin, now increasingly, synthetics such as mylar, are widely known to be among mankind's earliest prehistoric inventions. Because, by their nature, drums must enclose a relatively large volume of internal air-space and, with the exception of toy versions, have thus far been solely constructed of either metal, pottery/ceramic/clay, wood, and recently, particulate wood-fiber composites, they have always been among the most cumbersome of musical instruments.

Since as early as 1914's U.S. Pat. No. 1,113,253 to Schreiner, inventors have attempted to address the twin problems of unwieldiness and storability by creating various styles of drums featuring various forms of collapsibility. Perhaps the most common approach has been by fabricating a drum shell out of multiple annular bodies, each of lesser diameter than its predecessor, that can in some degree nest telescopically, and which can then, using various mechanisms, be extended and locked in an open configuration for play, as seen in U.S. Pat. No. 1,768,438 to Israel (SIL classified as an hourglass drum), U.S. Pat. No. 2,546,452 to Kmieliauskas (a hybrid of the cylindrical and conical styles) U.S. Pat. No. 4,455,913 to Willis (a conjoined triple Barrel Drum), and U.S. Pat. No. 7,786,364 to Natali (another cylindrical/conical hybrid). This telescoping approach has also been used to create drums capable of producing a multiplicity of pitches by playing them at different degrees of extension, such that the goals of portability/storability, and tonal versatility may be served by the same features of a single invention. This is exemplified by U.S. Pat. No. 8,829,320 to Tahour (an elongated hybrid of the Cylindrical and Conical styles), in which instance tonal range is perhaps treated as primary, portability/storability as secondary.

All known prior example use a purely cylindrical shape for the annular bodies that cooperatively form their respective drum shells. As a result, no structurally significant/stabilizing friction fitting exists between successive annular bodies. Rather, each of these embodiments must rely entirely, or nearly so, upon its mechanical locking systems to stay open for play. This inherently fails to maximize stability, vibratory/tonal conduction throughout the drum shell, and prevention of unwanted residual sounds such as buzzes and/or rattles. Moreover, U.S. Pat. No. 8,829,320 suffers these additional shortcomings:

1) Perhaps in service to its goal of pitch versatility, and by an inherent limitation of it's collapsing/expanding mechanism's design, this drum remains playable in its collapsed form, and is far from being able to fit fully into the profile of its widest/topmost annular body, thus failing to maximize portability/compactness.
2) The markedly "stepped" shape of its uniformly cylindrical annular bodies give an unfamiliar acoustic dynamics/wave flow and tubular appearance quite unlike its highly contoured/smoothly tapered, non-collapsible ancestors.

In contrast, art embodied by Collapsible Camping Cups in U.S. Pat. No. 879,753 to Eckert, and U.S. Pat. No. 6,666,329 to Charbonneau, demonstrate the effectiveness of friction-fitted sloping/conical walls to create a highly stable, water and air tight interface between annular bodies when similarly enclosing a large volume. In the context of a drum, this contoured and steady taper also imparts acoustic and visual aesthetics more in the tradition of Middle-Eastern and African hand drums. However, lacking any mechanism to secure them when collapsed, guide them smoothly through the opening/closing processes, and anchor them in place when open, such cups' annular bodies 1) rattle around within their outermost shell/housing when collapsed 2) have a sloppy/haphazard feel when carried and transitioned between open and closed configurations and 3) are easily inadvertently/prematurely collapsed. These flaws are reasonably acceptable in the use case of a camping cup. But given the rigors to which a drum is by its nature subjected, including the relentless impacts and vibrations of playing, and jostling when carried, a novel, convenient, reliable, locking and guidance system to operate in tandem with friction fitting is essential.

In addition to the foregoing, drums have historically been played either while seated, standing, walking/marching, or dancing, depending on their construction, playing techniques, and cultural role. Western marching band and latin drums, especially Snares, Tomtoms, mini-congas, and Bass drums, have been designed to accept a wide array of integrated and attachable strap and harness devices in order to allow them to be carried while in use. However, though rope-tuned drums like Africa's Dundun and Djembe are commonly outfitted with a tied-on strap or harness, and an aftermarket strap is available from Remo for use with a Doumbek, all previous incarnations of conical, hourglass, and goblet-style drums lack shell-integrated, convenient, dedicated attachment-points for this purpose. To my knowledge, the same lack is true of all previous collapsible drum designs.

Finally, all previous collapsible drums have lacked a way to thoroughly and attractively encapsulate their inner workings when closed, and to achieve quick and easy assembly/disassembly for efficient industrial fabrication and cleaning/troubleshooting/repair. This at once makes them vulnerable to malfunction through the infiltration of foreign matter into their mechanical elements, and precludes their easy and efficient restoration from same.

In conclusion, to my knowledge, no telescopically collapsible/expansible musical drum formerly developed provides maximal stability and/or portability, and/or aesthetic value, and/or dedicated in-built means to attach a strap for convenient playability and/or transport during any form of ambulation, and/or an easy means for assembly/disassembly/access for thorough cleaning and/or efficient repair and/or replacement of any of its constituent elements.

SUMMARY

1) Several new collapsible Drums, each having a shell comprised of several nesting annular bodies (in preferred embodiments an odd number ≥5, shown herein with embodiments of 5 and 7) whose interior and/or exterior walls are varyingly or uniformly sloped (ideally at 2-3%) along some or all of their heights/Z Axis] such that there may occur a stabilizing frictive interference between the bottom inner and top outer edges of pairs of annular bodies when the drum is extended.

Each embodiment of this drum further may have one or more of several locking mechanism, which may support and/or stabilizes it's friction fittings when fully and/or partially open, and/or serve to keep the drum reliably locked closed.

The preferred embodiment of these may function via a system of "Locking channels" positioned vertically along the inner edges of all annular bodies save the bottom-most. These may be designed to contain and guide "locking pegs" which may protrude at corresponding regular intervals along the outer upper edge of all annular bodies save the topmost.

These locking mechanisms may include a safeguard structure to prevent drum head damage in the event that the user attempts to collapse the drum while one or more annular bodies remain locked together in an "open" configuration.

The locking mechanism of the preferred embodiment may include an opening at the top of each locking channel to allow the insertion and egress of its housed locking pegs and the annular bodies to which they're attached, for initial construction, cleaning, lubrication, repair, and/or replacement of parts.

This drum's shell may be comprised of modern, preferably transparent/translucent materials novel to/unconventional in, the field of musical drums, such as Copolyester, Polycarbonate, Acrylic, carbon-fiber, fiber-glass etc., giving countless unique appearance and design possibilities, both when expanded and collapsed [note: need a separate design patent for this and all of it's potential iterations?] as well as unique tonal possibilities.

The drum also may include integrated attachment points on the exterior edges of its top/outermost and bottom/innermost annular bodies, and/or elsewhere, to receive single and/or double shoulder and/or waist/hip strap(s)/harnesses, for easy and convenient carrying and/or playing in either a fully open, closed, or intermediate (higher pitched) configuration.

Further, in some embodiments, including the preferred, and all others detailed herein, this drum may have a flare at the bottom of its lowermost annular body which may seal over all interior annular bodies and locking mechanisms of the collapsed drum to block the entry of debris and/or stabilize all inner annular bodies, and/or, provide an intriguing, neat, self-contained appearance when collapsed, and/or harbor the above-mentioned lower set of strap attachment-points, and/or, in cooperation with same, provide an effective manual interface whereby a user may introduce torsion and/or compression and/or expansive force, in order to transfer the drum into and out of its locked, open, closed, and intermediate configurations, and/or a stand, and/or an integration and/or attachment point for an iBeacon and/or other complementary and/or similar technology (such technology being also potentially attached at other places instead of, or in addition to, said flare.) In all embodiments, this flare may be detachable to allow for easy partial and/or total assembly/disassembly of the drum, which in the preferred embodiment, may be accomplished via the aforementioned locking-mechanism openings.

Further, in some embodiments, additional channels, grooves, and/or integration points at any place or places on and/or in the drum may be included to allow the wired and/or wireless mounting and/or embedding of a camera or cameras, LED(s) and/or other light sources, smartphones and/or other personal technical devices, and/or recording devices, and/or acoustic and/or electronic amplification systems, and/or bells, chimes, rattles, etc.

Accordingly, several advantages may be to provide

1) Through angled walls resulting in tight friction fitting between annular bodies, improved stability, vibratory conduction, and avoidance of undesired residual sounds
2) Through operational mechanisms and materials never previously applied to this art, improved functional reliability, reparability, and novel/attractive appearance.
3) Through near-total collapsibility into its outermost annular body, maximization of portability, storability and aesthetic appeal
4) Through, in some embodiments, providing a unique dedicated/integrated means for the dual purposes of applying torque to operate the drum's opening and closing mechanisms, and the easy attachment of carrying straps, a convenient, and satisfying experience in deploying and stowing the drum, and increased portability and playing versatility.
5) Through the inclusion of complementary technologies never before applied to the art (internal lighting, cameras, ibeacons, etc. . . . ) new ways to connect people around, through, and/or about, participatory music and/or dance/performance art.

2) An alternative version of the above, which may also be locked open and closed by friction fit, but instead of the described "locking channels" mechanism, may be supported in the open position by a system of tabs formed by vertical cuts along the bottom circumference of each but the last annular body. Each such "locking tab" may have a protrusion on its bottom inner edge which may fit into a corresponding groove or channel along the top outer edge of the adjacent inner ring. The protrusions and corresponding channels may get smaller/shallower on each successive ring proceeding from the top toward the bottom of the drum, so that it will take the least force to lock and release the bottom-most and incrementally more force to do so approaching the top. This is to ensure the rings unlock and collapse in proper sequence, from bottom to top, whenever compressive or expansive force is applied to the top and bottom of the drum. To lock the drum closed, there may be a similar system of locking tabs and ridges along the bottom outer edge of the top ring, and a specially designed lip of the bottom most. This version may also have simple vertical ridges or "fins" positioned similarly to the locking channels on the inside of each ring of the previous embodiment, to keep inner rings still and centered when in the closed position.

3) Another alternative version in which annular bodies are again held open by friction fitting of their sloped walls, but in this case that may be supported by screw threads on the bottom inner and top outer edges of each ring, save the top outer edge of the 1st ring, and the bottom inner edge of the last. This version may have a similar "lip" system to the 2nd embodiment, but with the screw-threads, rather than its locking tabs/grooves system. This version may also have simple vertical ridges positioned similarly to the locking channels of the first/preferred embodiment, on the outside and/or inside of each ring, to keep them still when in the closed position. This embodiment, and the 2nd/previous, will not have external locking protrusions as the 1st/preferred does, but will be uniformly relatively flat around their outer surfaces.

DRAWINGS

DETAILED DESCRIPTION

Figure 1:
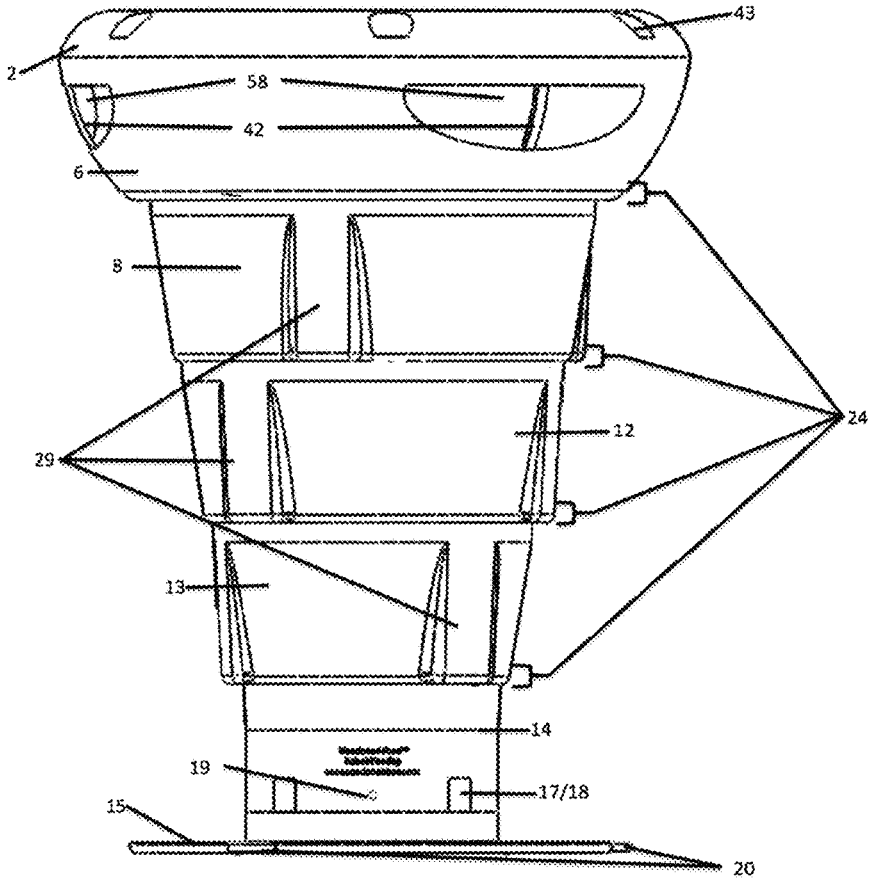
FIG. 1 is a perspective view showing Drum Preferred Embodiment 1 in its locked-open configuration.

FIG. 1 is a perspective view showing Drum Preferred Embodiment 1 in it's locked open configuration. Annular Bodies 6, 8, 12, 13, and 14 overlap and frictively fit at Interference Zones 24. Six of the nine Locking Mechanism External Cover Protrusions 29 are visible. The Drum is standing on Closure, Leverage, and Stability Flare 15, and two of the three Lower Strap-Mount & Leverage Projections 20, Upper Strap Mounting Bars 42, and Finger-hold and Strap-Mounting Recesses 58, are visible, as are Retaining Ring 2, Head Retention Ring Bolt Holes 43, Inner/Outer Flare Retention Bolt Holes 19/47, and Stability Teeth 17, and Standard Teeth Receiving Slots 18.

Figure 2:
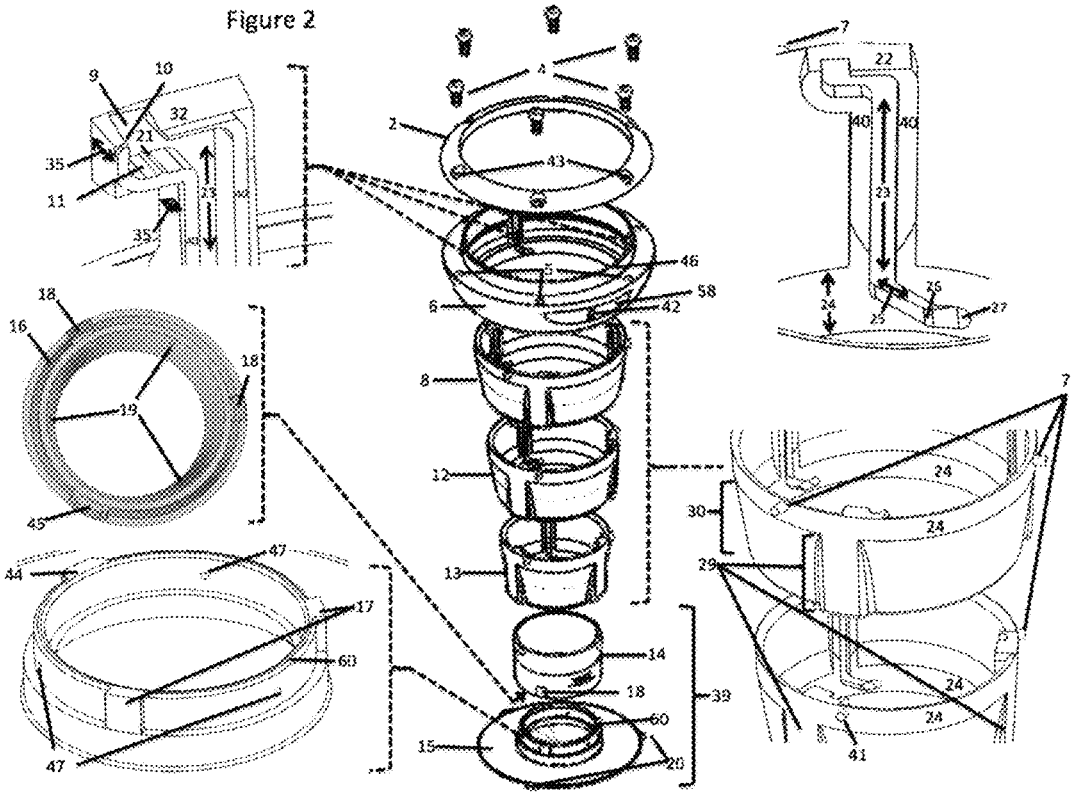
FIG. 2 is an exploded view showing all components of Drum Preferred Embodiment 1

FIG. 2 is an exploded view showing all components of Drum 1, with five detailed magnifications. Locking Pegs 7 of 2nd Annular Body 8 align with, and are slidingly received by, Dis/Assembly Ports 9 of 1st Annular Body 6 by passing frictively over Upper Retention Nodes 10 and coming to rest in Closed-Locking Grooves 11. This is repeated, with 3rd Annular Body 12 fitting into 2nd Annular Body 8, 4th Annular Body 13 into 12, and finally 5th Annular Body 14 into 13. Attachment Ridge 60 of Closure, Leverage, and Stability Flare 15 inserts into Flare Receiving Slot 16, such that Standard Inner Stability Teeth 17 fit into Standard Teeth Receiving Slots 18, Orientation Tooth 44 fits into Orientation Tooth Receiving Slot 45, and, Inner (19) and outer (47) Flare Retention Bolt Holes of 5th Annular Body 14 and Closure, Leverage, and Stability Flare 15, align. Application of sufficient torque causes all Locking Pegs 7 to pass frictively over Lateral Retention Nodes 21, under either Standard Closure Guards 22, or in the case of 1st Annular Body 6, Modified Sloping Closure Guards 32, and into the topmost ends of Locking & Stability Channels 23. Gravity, and/or any other opposite/pulling force between 1st Annular Body 6 and Closure & Leverage Assembly 39 (comprised of parts 14-20, 28, 44, 45, 47, & 60), causes a downward sliding motion of all Locking Pegs 7 and Annular Bodies 8, 12, 13, and 14/39, within all Locking & Stability Channels 23, between Locking & Stability Channel Walls 40, until a friction fit begins to occur at Interference Zones 24 between the lower inner edge of each outer Annular Body and the upper outer edge of each inner annular body, and all Locking Pegs 7 align with the upper edges of Open-Locking Channels 25. Sufficient torque drives each Locking Peg 7 in a diagonal downward course along its Open-Locking Channel 25, uniformly tightening the friction fits at Interference Zones 24. This process peaks when all Locking Pegs 7 reach Open-Locking Valleys 26, continuing outward and slightly up before finally coming to rest within Open-Locking Grooves 27. Flare Retention Bolts 28 (not shown) are then installed through Inner Flare Retention Bolt Holes 19 with their heads on the interior of the drum, pointing out. They continue through Outer Flare Retention Bolt Holes 47. Drumhead 3 (not shown) is positioned over Drum Head Mounting Ridge 46. Head Retention Ring 2 is placed on top of Drumhead, with Drumhead Receiving Groove 48 (see FIG. 3.) over Drumhead-Integrated Tightening Lip 49 (not shown) and anchored by installing Head Bolts 4, through Head Retention Ring Bolt Holes 43, and into 1st Annular Body 6 at Head Anchor Wells 5. The drum is now fully assembled and operative. Locking Mechanism External Cover Protrusions 29, Preferred 2-Degree Wall Slope 30, and the Increasing Projection of Locking Channel Height with Increasing Proximity to Top of Each Annular Body 35, are also visible. A strap or straps (not shown) may be attached at Upper Strap Mount Bars/Recesses 42/58, and/or Lower Strap-Mount & Leverage Projections 20

Figure 3:
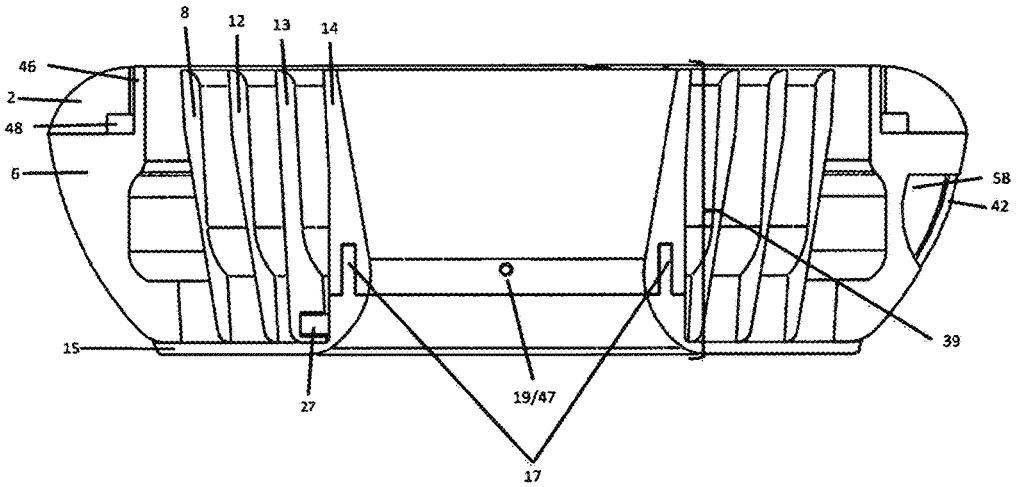
FIG. 3 is a lateral cross-section of the preferred embodiment in its collapsed and locked closed configuration.

FIG. 3 is a lateral cross-section of Drum Preferred Embodiment 1 in its collapsed configuration. Head Retaining Ring 2 has been installed on 1st Annular Body 6, 2nd Annular Body 8 is nested in 6, 3rd Annular Body 12 nested in 8, 4th Annular Body 13 nested in 12, 5th Annular Body 14 nested in 13, and Closure, Leverage, and Stability Flare 15 fits snugly against the bottom of 6. Inner Stability Teeth 17 have been inserted in Teeth Receiving Slots 18, and Inner/Outer Flare Retention Bolt Holes 19/47 aligned. The end of one Open-Locking Groove 27, is visible within 13. Closure & Leverage Assembly 39, Upper Strap Mount Bars 42, Drum Head Mounting Ridge 46, Drumhead Receiving Groove 48, and Finger-hold and Strap-Mounting Recesses 58 are all visible.

Figure 4:
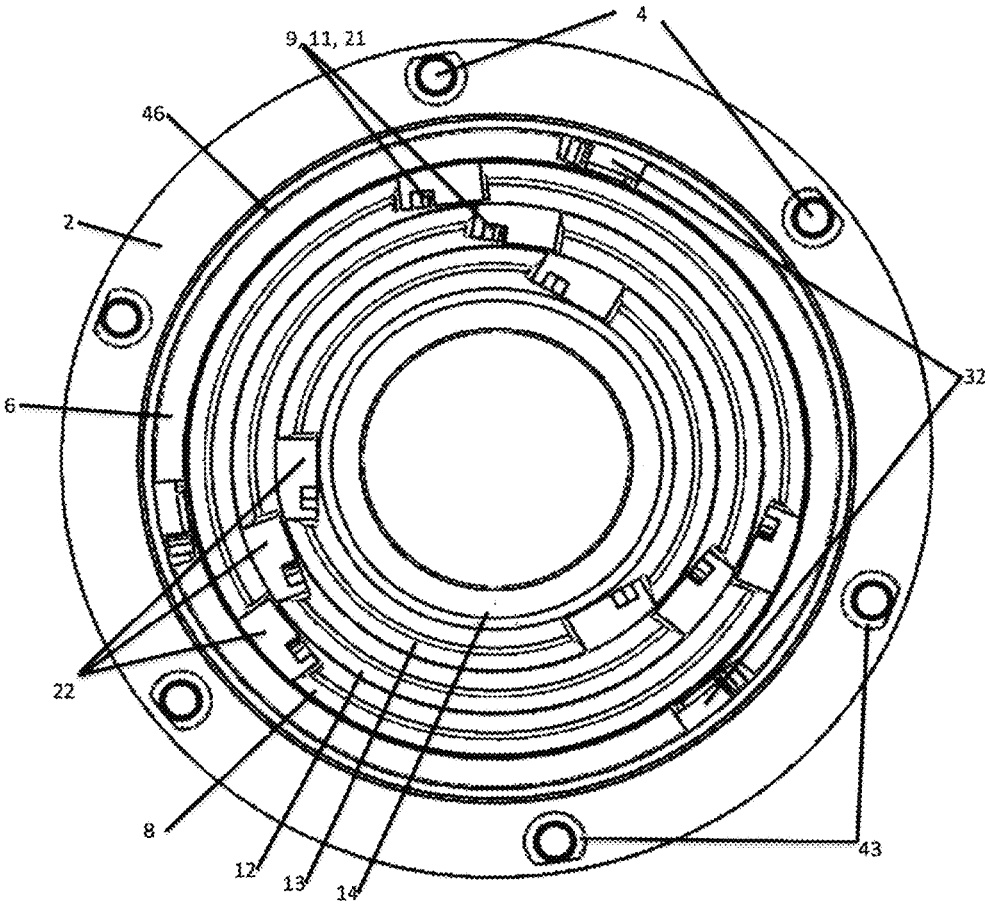
FIG. 4 is a top-down view of the preferred embodiment, in its collapsed, but unlocked, closed configuration, with its skin/head removed.
Figure 5:
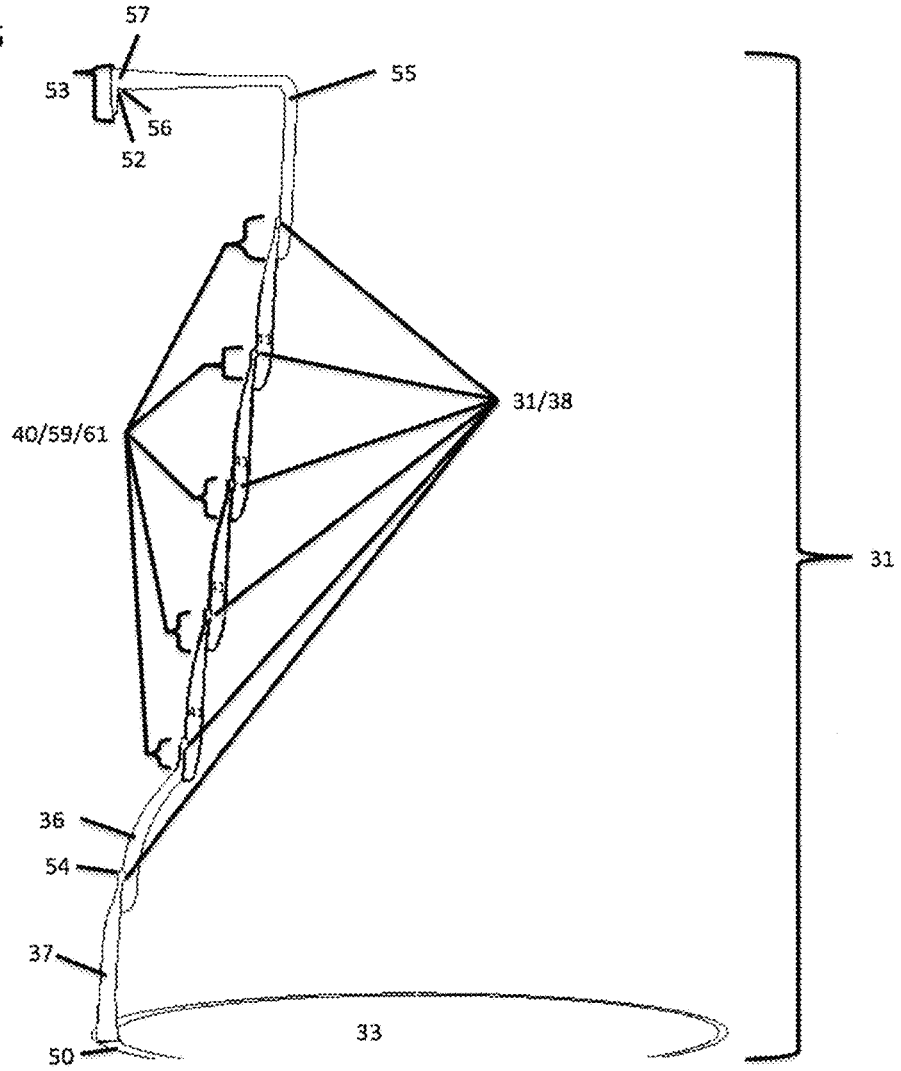
FIG. 5 is a silhouette cross section of the 2nd embodiment with glue-mounted drum-head, in locked-open/playable position

FIG. 4 is a top-down view of the preferred embodiment, with its skin/head removed, in a collapsed, closed, but unlocked configuration. It shows Head Retaining Ring 2, Head Bolts 4, and Head Retention Ring Bolt Holes 43, installed over/into 1st Annular Body 6, which is housing 2nd Annular Body 8, in turn 3rd Annular Body 12, in turn 4th Annular Body 13, and finally 5th Annular Body 14/Closure & Leverage Assembly 39. Dis/Assembly Ports 9, Closed-Locking Grooves 11, Lateral Retention Nodes 21, Standard Closure Guards 22, Modified Sloping Closure Guards 32, Head Retention Ring Bolt Holes 43, and Drum Head Mounting Ridge 46 are all visible FIG. 5. is an inverted silhouette cross-section of 2nd Embodiment Drum Variant 34, in a Locked Open configuration. 2E Drum Skin 33 has been attached with glue at 2E Drum Head Rim/Gluepoint 50. 2E Deepened 2nd Ring 36, 2E Outer Ring 37, four Annular Bodies 41 are interlocked by friction fit between 2E Locking Tab Interference Zones 59, and Ring Body Interference Zones 61 and reinforced by Open-Locking Nodes 38 of 2E Locking Tabs 40 resting within 2E Locking Channels 31. 2E Closed-Locking Nodes 52, 2E Closed-Locking Lip 53, 2E Closed-Locking Hook 54, 2E Flared Inner/Closure/Standing Ring 55, 2E Flare Closure Groove 56, 2E Trumpeted-Flare 57 are also visible.

Figure 6:
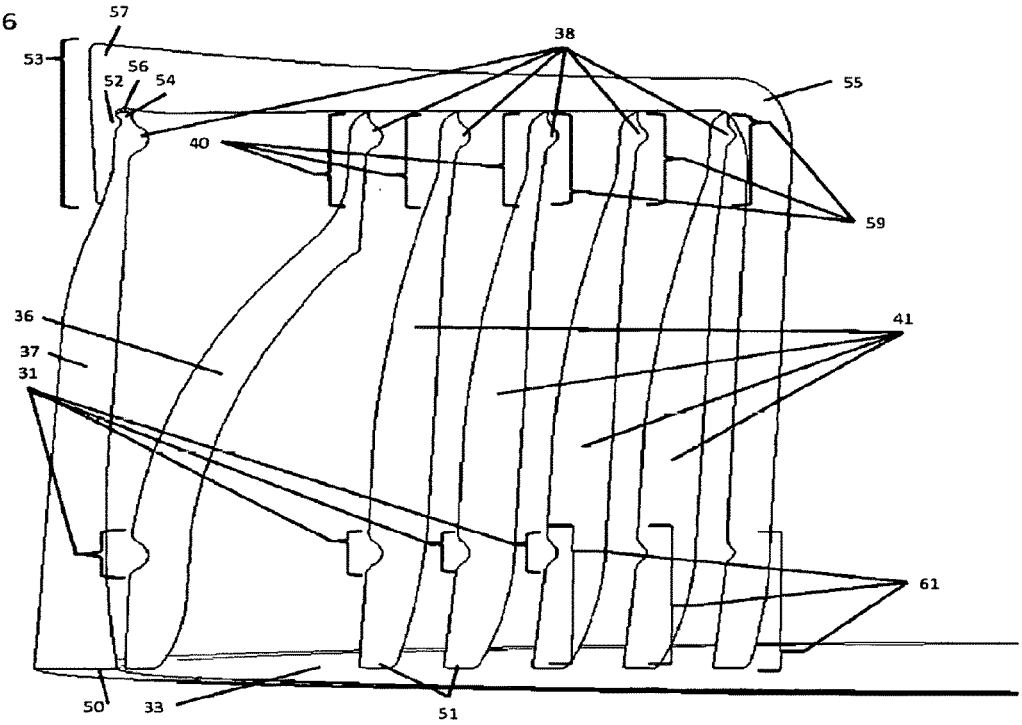
FIG. 6 is a silhouette cross section of the 2nd embodiment with glue-mounted drum-head, in its collapsed and locked position

FIG. 6. is an inverted collapsed cross-section of 2nd Embodiment Drum Variant 34, showing 2E Locking Channels 31, and the 2E Open-Locking Nodes 38 of Locking Tabs 40, and 2E Locking Tab Interference Zones 59, and Ring Body Interference Zones 61 now disengaged and separated. 2E Skin-safe Flattened Annual Body Tops 51 are flush with 2E Drum Skin 33, which has been attached with glue at 2E Drum Head Rim/Gluepoint 50. (Alternative designs may allow for drum-head attachment as in Preferred Embodiment 1, or by other means.) 2E Deepened 2nd Ring 36, and four Annular Bodies 41, are collapsed and contained within 2E Outer Ring 37 exteriorly, and 2E Flared Inner/Closure/Standing Ring 55 interiorly. 2E Closed-Locking Node 52 of 2E Closed-Locking Lip 53 has received 2E Closed-Locking Hook 54 at 2E Flare Closure Groove 56, holding the drum closed.

Figure 7:
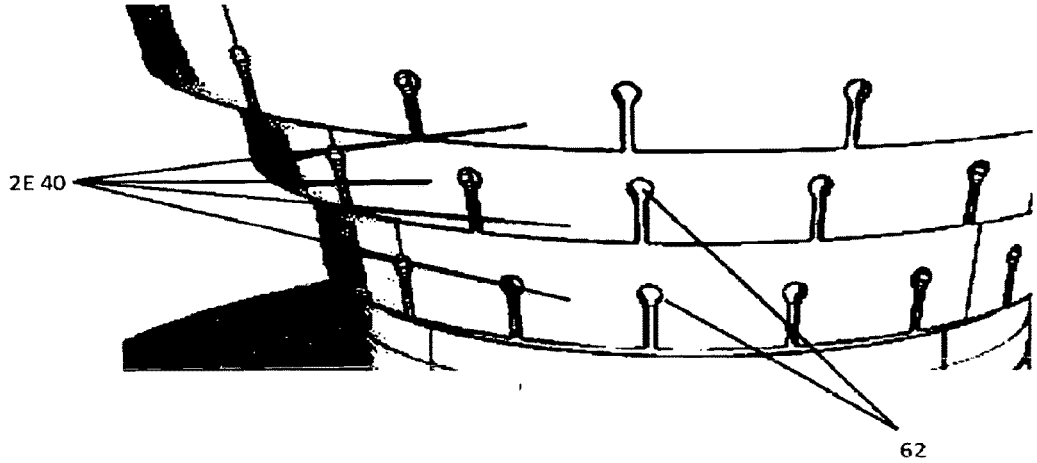
FIG. 7 is a frontal view of the 2nd embodiment in its locked-open position

FIG. 7. Is a front view of the 2nd Embodiment Drum 34, in a Locked Open configuration. 40 2E locking tabs/2E Interference Zones, and 62 Locking Tab Slits are shown in operation.

REFERENCE NUMBERS

1 Drum Preferred Embodiment
2 Head Retention Ring
3 Drumhead (not shown)
4 Head Bolts
5 Head Anchor Wells
6 1st Annular Body
7 Locking Pegs
8 2nd Annular Body
9 Dis/Assembly Ports
10 Upper Retention Nodes (not shown)
11 Closed-Locking Grooves
12 3rd Annular Body
13 4th Annular Body
14 5th Annular Body
15 Closure, Leverage, and Stability Flare
16 Flare Receiving Slot
17 Inner Stability Teeth
18 Teeth Receiving Slots
19 Inner Flare Retention Bolt Holes
20 Lower Strap-Mount & Leverage Projections
21 Lateral Retention Nodes
22 Standard Closure Guards
23 Locking & Stability Channels
24 Interference Zones
25 Open Locking Channels
26 Open-Locking Valleys
27 Open-Locking Grooves
28 Flare Retention Bolts (not shown)
29 Locking Mechanism External Cover Protrusions
30 Preferred Wall Slope
31 2E Locking Channels
32 Modified Sloping Closure Guards
33 2E Drum Skin (Glued on to base/exterior of outermost ring)
34 2nd Embodiment Drum Variant
35 Locking Channel Projection Height Increases Proportional to Proximity to Top of Each Annular Body
36 2E Deepened 2nd Ring
37 2E Outer Ring
38 2E Open-Locking Nodes
39 Closure & Leverage Assembly (Comprises 14-20 & 28)
40 2E locking tabs/2E Interference Zones
41 2E Annular Body
42 Upper Strap Mounting Bars
43 Head Retention Ring Bolt Holes
44 Orientation Tooth
45 Orientation Tooth Receiving Slot
46 Drum Head Mounting Ridge
47 Outer Flare Retention Bolt Holes
48 Drumhead Receiving Groove
49 Drumhead-Integrated Tightening Lip 49 (Not Shown)
50 2E Drum Head Rim/Gluepoint
51 2E Skin-safe Flattened Annual Body Tops
52 2E Closed-Locking Node
53 2E Closed-Locking Lip
54 2E Closed-Locking Hook
55 2E Flared Inner/Closure/Standing Ring
56 2E Flare Closure Groove
57 2E Trumpeted-Flare
58 Finger-hold and Strap-Mounting Recesses
59 2E Locking Tab Interference Zones
60 Attachment Ridge
61 Ring Body Interference Zones
62 Locking Tab Slits Operation Embodiment 1, Preferred For transporting the drum in a compact non-playable configuration may be carried in a bag, by hand, or by user-installed, non-integrated strap(s). Versions that include integrated strap attachment points may also be be carried over one or both shoulders by a strap or straps attached thereto. To prepare for play, the drum may be unlocked, partially (if applicable—embodiments not shown, but may include additional Open-locking channel/valley/groove assemblies above, or above and opposite, the ones depicted) or fully expanded, and locked open by various means, depending upon the specific embodiment in question.

In the case of the preferred embodiment, the top/outermost segment will be twisted relative to the bottom segment, causing the closed-locking mechanisms of all segments to loosen via the process described in the Detailed Description above. The drum is then pulled or shaken into an extended position, and further torque applied between the aforementioned sections, causing the open-locking mechanisms of all segments to activate.

In another embodiment, a similar process is followed, but without twisting, due to the use of straight locking channels.

In another embodiment, a similar process is followed, but with less or no twisting, due to the use of curved locking channels.

In another embodiment, a similar process is followed, but without twisting, as the drum is pulled directly open to release the "closed locking tabs" and activate the "open locking tabs"

In another embodiment, a similar process to the first is followed, but whereby the twisting motions release and engage threaded screw areas around the edges of the annular bodies. This may demand a greater degree of torque to achieve locking/unlocking.

In another embodiment of the closed-locking mechanism, projections may be located on the top edge of the bottom "flare" segment which may be received by channels along the bottom edge of the topmost segment. Once these projections are received by said channels, torsion may be applied to lock them in place, locking the drum closed, to be opened by a reversal of the process.

Other embodiments may employ any combination of these mechanism, and operate accordingly.

Once opened/extended, the drum may be played with hands or sticks in traditional/conventional postures; seated and held between or across the knees/a knee or cross legged with the drum over one thigh. It may also be played suspended on one side of the user by its shoulder strap, or over the midline of the user's torso, held in place by a duel "backpack" style strap/harness. Play during suspension from the strap(s) may be accomplished while seated, standing, walking, running, dancing, or otherwise active.

To return the drum to a collapsed configuration, the steps previously outlined are applied in reverse.

PRIOR ART OF NOTE

U.S. Pat. No. 7,786,364—Percussion Musical Instrument, Natali—2008
U.S. Pat. No. 8,829,320—Collapsible musical Drum, Tahour—2014
U.S. Pat. No. 4,455,913—Collapsible Drum, Willis—1983
U.S. Pat. No. 1,768,438—Collapsible Drum, Israel—1930
U.S. Pat. No. 2,546,452—Telescoping Drum to Kmieliauskas—1949
U.S. Pat. No. 4,060,019 Adjustable Drum, Cordes—1976
U.S. Pat. No. 2,563,346—[collapsible] Drum—1948—Livingston
U.S. Pat. No. 3,215,021—[Variable Pitch] Drum—1965—Kester
U.S. Pat. No. 1,214,171—Collapsible Drum, King—1916
U.S. Pat. No. 8,525,010—Portable Drum, Saravis—2013
U.S. Pat. No. 578,198—Drum, Boulanger—1897
U.S. Pat. No. 1,113,253 Collapsible Drum—to Schreiner—1913
U.S. Pat. No. 1,223,237—[Collapsible Bass] Percussion Drum—Barry—1917
U.S. Pat. No. 7,781,660—Expandable Drum—Paterson—2010
U.S. Pat. No. 4,300,437—Sectionalized Drum—Hinger—1981
U.S. Pat. No. 4,616,551—Adjustable pitch drum—Brookvich—1986
U.S. Pat. No. 7,781,659—Adjustable Modular Drum, Liao—2008
U.S. Pat. No. 219,474—Combined collapsible drinking cup and cover therefor—Gahm—1970
U.S. Pat. No. 4,978,021—
U.S. Pat. No. 5,226,551—
U.S. Pat. No. 7,114,676 B2 to Elliott, Knight, and Dey:

What is claimed is:

1. A Telescoping Musical Drum, comprising: at least two annular bodies, which can be extended into overlapping end-to-end positions, wherein the last/innermost of said annular bodies has a flared bottom edge and the flared bottom edge extends out to, and forms a seal against, the bottom edge of said 1st annular body when said drum is in a closed configuration, wherein the flare is de- and re-attachable to the bottom of its said annular body, in which said de- and re-attachment is accomplished via a channel and peg fit mechanism between the parts to be joined.

2. The drum of claim 1 in which said annular bodies are locked in place via friction-fit and/or one more locking mechanisms.

3. The drum of claim 1 in which said annular bodies are locked closed by one or more locking mechanisms.

4. The drum of claim 1 in which the walls of said annular bodies are sloped.

5. The drum of claim 1 in which the attachment of said parts is strengthened by the addition of a bolt, bolts, or equivalent hardware.

6. The drum of claim 1 in which said channel and peg fit mechanism comprises vertical channels or grooves in the inner walls of said annular bodies and corresponding projections emanating from the outer walls of each next inner annular body, to be slidingly received by said channels.

7. The drum of claim 6 in which said channels shall have a partially or entirely horizontal portion at their lower extremity into which said pegs slide when torque is applied to said annular bodies, locking the drum into an "open" configuration.

8. The drum of claim 6 in which said horizontal channels have, near the ends of said channels, bumps or projections which said pegs may pass over, and by which said projections pegs may be held in place during said drum's "open" configuration.

9. The drum of claim 6 in which said channels shall have a partially or entirely horizontal portion at their upper extremity into which said pegs slide when torque is applied to said annular bodies.

10. The drum of claim 6 in which said channels shall have a partially or entirely horizontal portion near their upper extremity into which said pegs slide when torque is applied to said annular bodies, locking the drum into a "closed" configuration.

11. The drum of claim 9 in which said horizontal channels have, near the ends of said channels, bumps or projections, which said pegs may pass over, and by which said pegs may be held in place during said drum's "closed" configuration.

12. The drum of claim 1 in which the outermost of said annular bodies have recesses for the carrying of said drum.

13. The drum of claim 12 in which said recess shall contain integrated anchor-points.

14. The drum of claim 1 in which the outer edge of at least one of the annular bodies has integrated holes or loops.

15. The drum of claim 1 in which said channels shall project through the walls of corresponding said annular rings which may cause corresponding raised areas on the outer faces of said annular bodies.

16. A Telescoping Musical Drum, comprising: at least two annular bodies, which can be extended into overlapping end-to-end positions, wherein the open-locking mechanism is comprised of screw-threads around the bottom-inner and corresponding top-outer edges of said annular rings.

17. The drum of claim 16 in which the closed-locking mechanism is comprised of screw-threads around the bottom-inner and corresponding top-outer edges of the first/top/outermost annular ring, and said flare of said last/bottom/innermost annular rings.

18. A telescoping musical drum, comprising:

at least two truncated, conical annular bodies, which can be extended into overlapping end-to-end positions, wherein the open-locking mechanism is accomplished via the increasingly tight friction fit created by extending such concentric conical bodies, working in combination with a ridge or ridges surrounding the lower or upper inner or outer edge of each of said annular bodies that may fit into a groove surrounding the corresponding lower inner or upper outer edge of said adjacent annular body.

19. The drum of claim 18, in which said drum is held closed by a system of projections similarly interfacing between a said flare or flares and the outer lower edge of said 1st annular body or bodies.

20. The drum of claim 18 in which vertical slits around the circumference of the bottom edge of all but the last of said annular bodies allow said edges to separate when said annular bodies are pulled apart or compressed by the user, thus facilitating the movement of the ridge or ridges into and out of the corresponding groove or grooves.

* * * * *